US011000732B2

(12) United States Patent
Ho

(10) Patent No.: US 11,000,732 B2
(45) Date of Patent: May 11, 2021

(54) TOTAL AB EXERCISE DEVICE

(71) Applicant: TOPWAY HIGHTECH ELECTRONICS (XIAMEN) CO., LTD, Fujian (CN)

(72) Inventor: Wei-Teh Ho, Taipei (TW)

(73) Assignee: TOPWAY HIGHTECH ELECTRONICS (XIAMEN) CO., LTD, Fujian (CN)

( * ) Notice: Subject to any disclaimer, the term of this patent is extended or adjusted under 35 U.S.C. 154(b) by 66 days.

(21) Appl. No.: 16/424,195

(22) Filed: May 28, 2019

(65) Prior Publication Data

US 2020/0376334 A1 Dec. 3, 2020

(51) Int. Cl.
*A63B 23/02* (2006.01)
*A63B 21/00* (2006.01)

(52) U.S. Cl.
CPC ..... *A63B 23/0205* (2013.01); *A63B 21/4039* (2015.10); *A63B 21/4033* (2015.10)

(58) Field of Classification Search
CPC ..... A63B 22/0056; A63B 22/0069; A63B 22/0066; A63B 22/0064; A63B 22/0061; A63B 2022/0074; A63B 2022/0071; A63B 2022/0051–0053; A63B 2208/0214; A63B 21/4033; A63B 2023/003; A63B 21/068; A63B 21/4047
See application file for complete search history.

(56) References Cited

U.S. PATENT DOCUMENTS 4,989,860 A * 2/1991 Iams ..... A63B 23/0355 482/132
7,901,329 B2 * 3/2011 Tsai ..... A63B 22/14 482/51
8,088,048 B2 * 1/2012 Tsai ..... A63B 22/0069 482/96
2011/0183828 A1 * 7/2011 Ho ..... A63B 22/14 482/142
2018/0015321 A1 * 1/2018 Ho ..... A63B 21/00069

* cited by examiner

*Primary Examiner* — Jennifer Robertson
*Assistant Examiner* — Catrina A Letterman
(74) *Attorney, Agent, or Firm* — Womble Bond Dickinson (US) LLP

(57) ABSTRACT

An exercise equipment assembly includes a stationary base including a front elongated support structure, a back elongated support structure, and a support body coupled between the front and back elongated support structures. An elongated handle is coupled to the support body and extends vertically away from the support body. The elongated handle includes a first pivot assembly coupled to the support body that allows the elongated handle to pivot about its vertical axis. A knee supporting structure is coupled to the support body and includes a second pivot assembly coupled to the support body. First and second knee supporting structures are coupled to the second pivot assembly, the first and second knee supporting structure extending horizontally away from the second pivot assembly in a direction generally opposite from the elongated handle. The second pivot assembly allows the first and second knee supporting structures to pivot about its vertical axis.

18 Claims, 7 Drawing Sheets

TOTAL AB EXERCISE DEVICE

TECHNICAL FIELD

Embodiments of the present disclosure relate generally to an exercise equipment assembly. More particularly, embodiments of the disclosure relate to an abdominal exercise equipment assembly.

BACKGROUND

In today's society, more and more people desire to exercise for various reasons such as to improve and maintain their health or to lose weight. Such exercise can be done in a fitness gym, outdoors, or at home. The stomach or abdomen is one area of the body that people focus on in their exercise routine to improve their health and to decrease their waistline. Other parts of the body such as the inner thigh and the buttocks are also exercised to improve the tone of those body parts or to improve the overall health of the person.

BRIEF DESCRIPTION OF THE DRAWINGS

Embodiments of the disclosure are illustrated by way of example and not limitation in the figures of the accompanying drawings in which like references indicate similar elements.

DETAILED DESCRIPTION

Various embodiments and aspects of the disclosures will be described with reference to details discussed below, and the accompanying drawings will illustrate the various embodiments. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosures.

Reference in the specification to "one embodiment" or "an embodiment" means that a particular feature, structure, or characteristic described in conjunction with the embodiment can be included in at least one embodiment of the disclosure. The appearances of the phrase "in one embodiment" in various places in the specification do not necessarily all refer to the same embodiment.

According to some embodiments, an exercise equipment assembly includes a stationary base including a front elongated support structure, a back elongated support structure, and a support body coupled between the front and back elongated support structures. The exercise equipment assembly further includes an elongated handle coupled to the support body and extending generally vertically away from the support body, the elongated handle including a first pivot assembly coupled to the support body, the pivot assembly to allow the elongated handle to pivot about its vertical axis and a knee supporting structure coupled to the support body. The knee supporting structure includes a second pivot assembly coupled to the support body, a first knee supporting structure coupled to the second pivot assembly, the first knee supporting structure extending horizontally away from the second pivot assembly in a direction generally opposite from the elongated handle, and a second knee supporting structure coupled to the second pivot assembly. The second knee supporting structure extends horizontally away from the second pivot assembly in a direction generally opposite from the elongated handle in which the second pivot assembly to allow the first and second knee supporting structures to pivot about its vertical axis.

Figure 1:
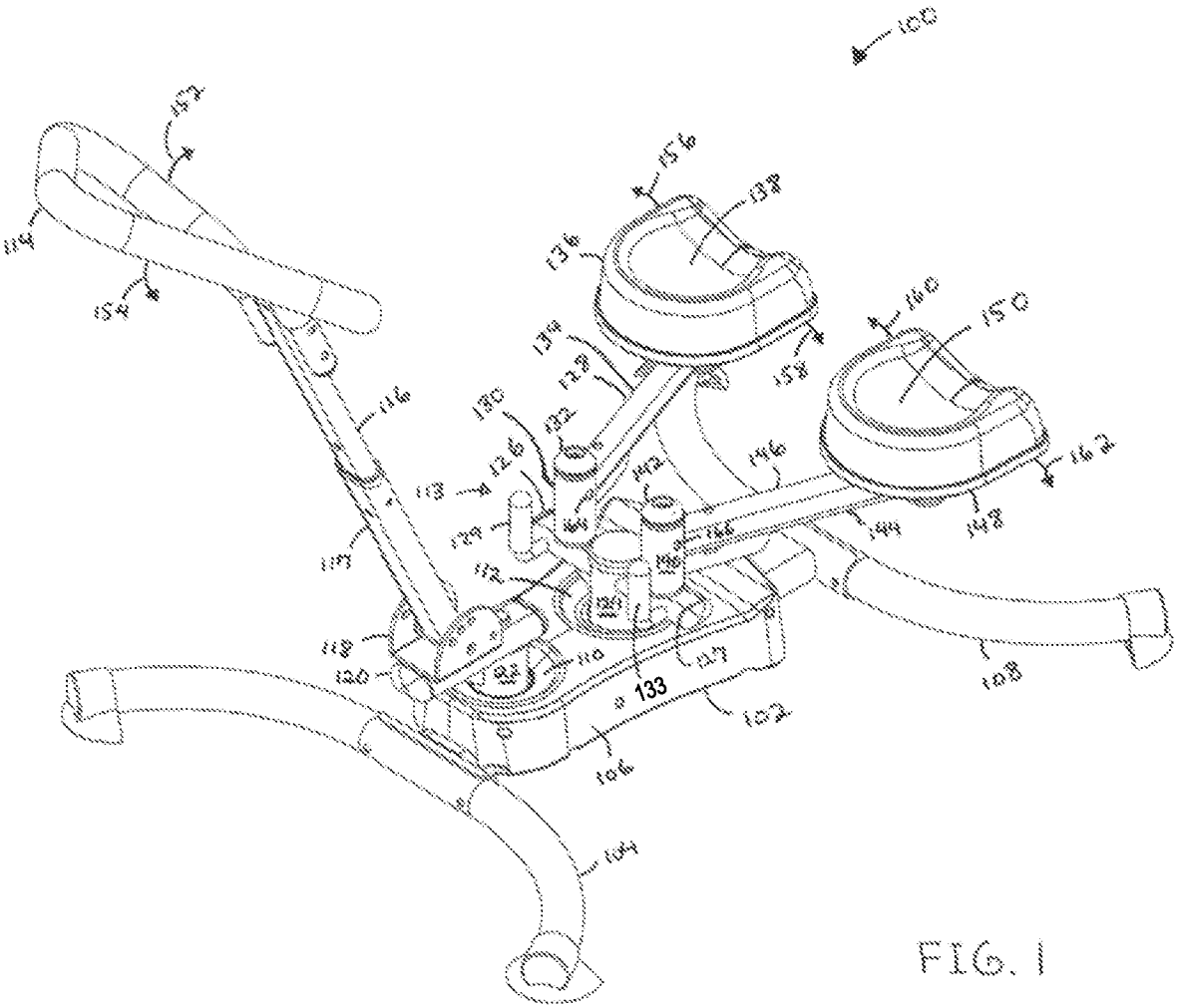
FIG. 1 is a perspective view of an exercise equipment assembly according to one embodiment.

With reference to FIG. 1, an exercise equipment assembly 100 according to one embodiment includes a stationary base 102 including a front elongated support structure 104, a back elongated support structure 108, and a support body 106 coupled between the front 104 and back 108 elongated support structures, and an elongated handle 116 coupled to the support body 106 and extending generally vertically away from the support body 106. The front elongated support structure 104 and the back elongated support structure 108 are for supporting the exercise equipment assembly 100 on a floor. The elongated handle 116 includes a first pivot assembly 122 coupled to the support body 106, the pivot assembly 122 to allow the elongated handle 116 to pivot about its vertical axis. Exercise equipment assembly 100 further includes a knee supporting structure 113 coupled to the support body 106, the knee supporting structure including a second pivot assembly 124 coupled to the support body 106, a first knee supporting structure 128 coupled to the second pivot assembly 124, the first knee supporting structure 128 extending horizontally away from the second pivot assembly 124 in a direction generally opposite from the elongated handle 116, and a second knee supporting structure 144 coupled to the second pivot assembly 124, the second knee supporting structure 144 extending horizontally away from the second pivot assembly 124 in a direction generally opposite from the elongated handle 116, wherein the second pivot assembly 124 to allow the first 128 and second 144 knee supporting structures to pivot about its vertical axis (e.g., swing left and right).

Continuing with FIG. 1, in one embodiment, each of the first and second knee supporting structures includes a cylindrically-shaped body (e.g., 130 or 140) disposed adjacent to the second pivot assembly 124, the cylindrically-shaped body (e.g., 130) including a cavity 164 for receiving a removable pin (not shown). The removable pin may suitably include a cylindrically-shaped metal pin with a stopper at one end such that the removable pin may be inserted into the cavity 164 and similarly, another removable pin may be inserted into a cavity 166 of cylindrically-shaped body 140. In one embodiment, when the removable pins are inserted into the cavities (e.g., 164, 166), the entire first and second knee supporting structures are allowed to pivot in unison and when the removable pins are removed from the cavities 164, 166 as part of another operation mode of the exercise equipment assembly 100, the first and second knee supporting structures are allowed to pivot towards (e.g., as shown by arrows 158, 160) and away (e.g., as shown by arrows 156, 162) from each other. In one embodiment, the first pivot assembly 122 is disposed at one end (e.g., proximate end) of the elongated handle 116. In one embodiment, the body 106 includes a cavity 112 and the second pivot assembly 124 is disposed in the cavity 112 of the support body 106. In one embodiment, the knee supporting structure 113 further includes a first support member 126 and a second support member 127, each member extending horizontally or radially away from the second pivot assembly 124 and in opposite directions from each other as shown in FIG. 1.

Continuing with FIG. 1, in one embodiment, the first knee supporting structure 128 includes a first cylindrically-shaped body 130 attached to the first support member 126, a first elongated member 134 attached to and extending horizontally away from the first cylindrically-shaped body 130, and a first knee support 136 attached to a distal end of the first elongated member 134. In one embodiment, the first cylindrically-shaped body 130 includes a horizontally extending through-hole 164 for receiving a removable pin (not shown). In one embodiment, when the removable pin is inserted into the through-hole 164, the first cylindrically-shaped body 130 pivots and when the removable pin is removed from the through-hole 164, an outer shell portion 131 (see FIG. 6) of the first cylindrically-shaped body 130 pivots while an inner portion 132 of the first cylindrically-shaped body 130 is fixed.

In one embodiment, the first knee support 136 includes a cavity 138 for supporting a knee of a user. In one embodiment, the second knee supporting structure 144 includes a second cylindrically-shaped body 140 attached to the second support member 127, a second elongated member 146 attached to and extending horizontally away from the second cylindrically-shaped body 140, and a second knee support 148 attached to a distal end of the second elongated member 146. In one embodiment, the second cylindrically-shaped body 140 includes a horizontally extending through-hole 166 for receiving a removable pin (not shown).

In one embodiment, when the removable pin is inserted into the through-hole 166, the second cylindrically-shaped body 140 pivots and when the removable pin is removed from the through-hole 166, an outer shell portion of the second cylindrically-shaped body 140 pivots while an inner portion 142 of the second cylindrically-shaped body 140 is fixed. In one embodiment, the second knee support 148 includes a cavity 150 for supporting a knee of a user. In one embodiment, each of the front 104 and back 108 elongated support structures is curved in a direction opposite from each other. In one embodiment, the elongated handle 116 includes a generally triangularly-shaped handle bar 114 disposed at a distal end of the elongated handle 116, a shaft 117 for allowing the height of the handle 116 to be adjusted, a shaft support 118 for supporting the shaft 117, and a handle base structure 120 attached to the shaft support 118 and first pivot assembly 122 as shown in FIG. 1.

In one embodiment, the first pivot assembly 122 is disposed in a cavity 110 within the support body 106. Knee supporting structure 113 further includes a first generally L-shaped member 129 and a second generally L-shaped member 133, each L-shaped member attached to and extending away from their respective support member. The first generally L-shaped member 129 limits the rotation (denoted by arrow 156) of the first knee supporting structure 128 in a counter-clockwise direction and the second generally L-shaped member 131 limits the rotation (denoted by arrow 162) of the second knee supporting structure 144 in a clockwise direction. In one embodiment, the first pivot assembly 122 is longitudinally spaced apart from the second pivot assembly 122 along a longitudinal axis of the support body 106. In one embodiment, the second pivot assembly 124 is positioned between the first knee supporting structure 128 and the second knee supporting structure 144 such that the first knee supporting structure 128 is on one side of the second pivot assembly 124 and the second knee supporting structure 144 is on the other side of the second pivot assembly 124.

Figure 2:
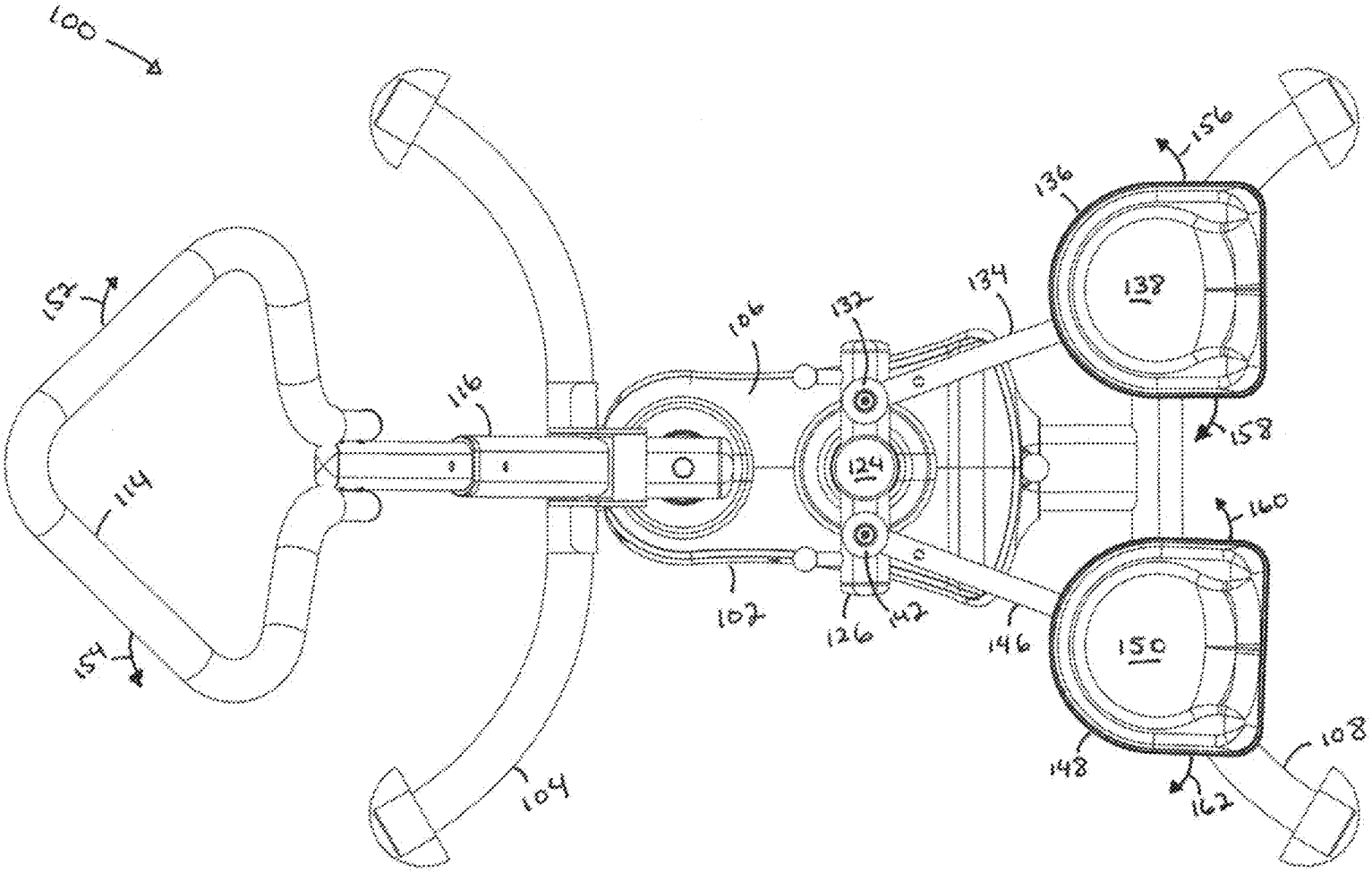
FIG. 2 is a top view of an exercise equipment assembly according to one embodiment.
Figure 3:
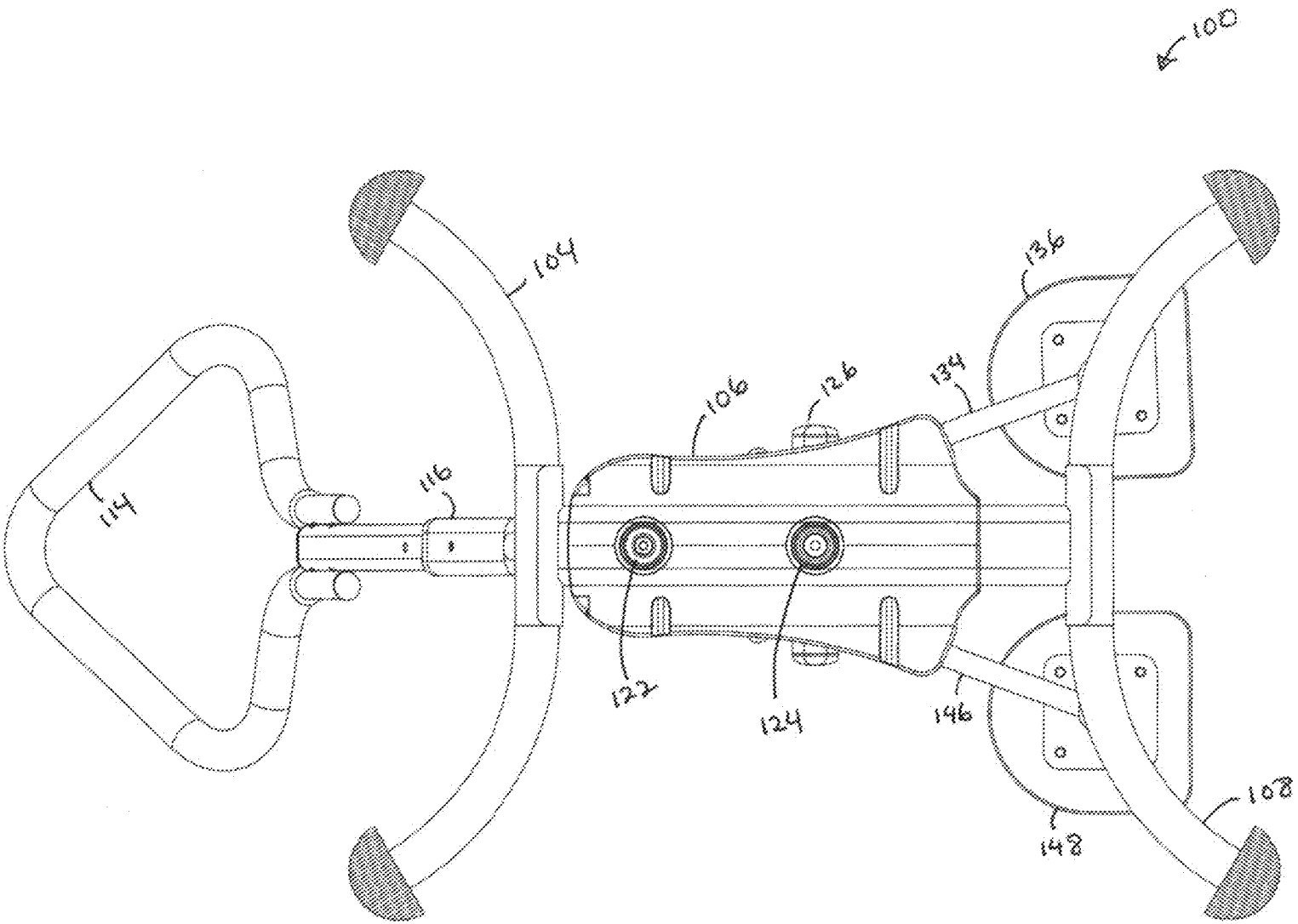
FIG. 3 is a bottom view of an exercise equipment assembly according to one embodiment.
Figure 4:
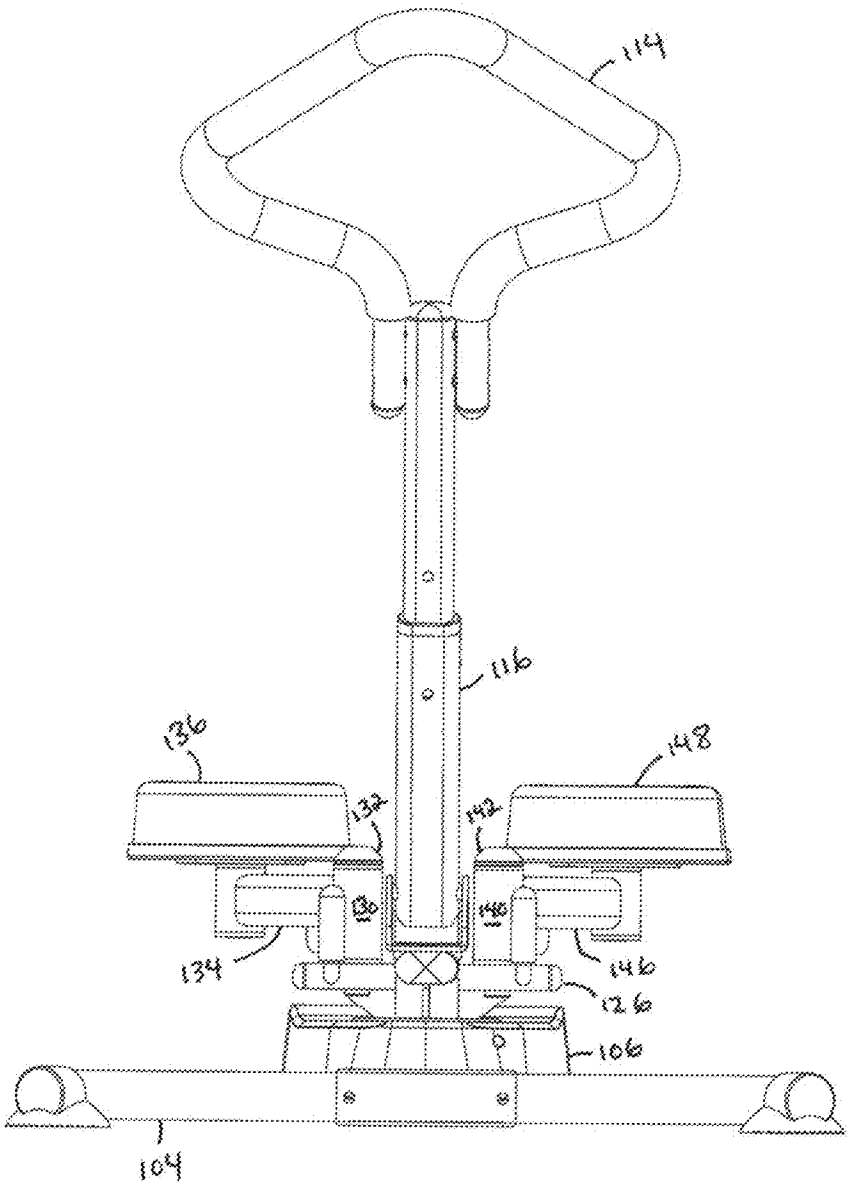
FIG. 4 is a front view of an exercise equipment assembly according to one embodiment.
Figure 5:
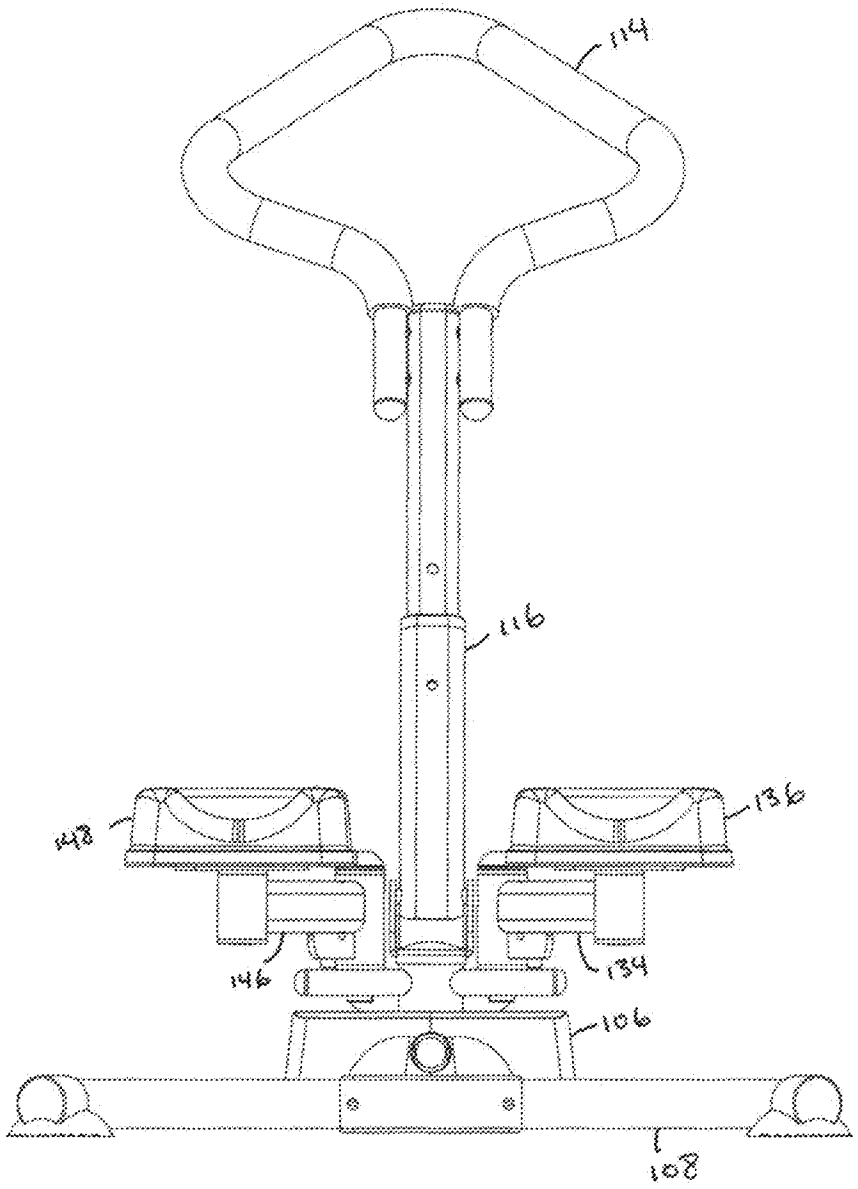
FIG. 5 is a back view of an exercise equipment assembly according to one embodiment.
Figure 6:
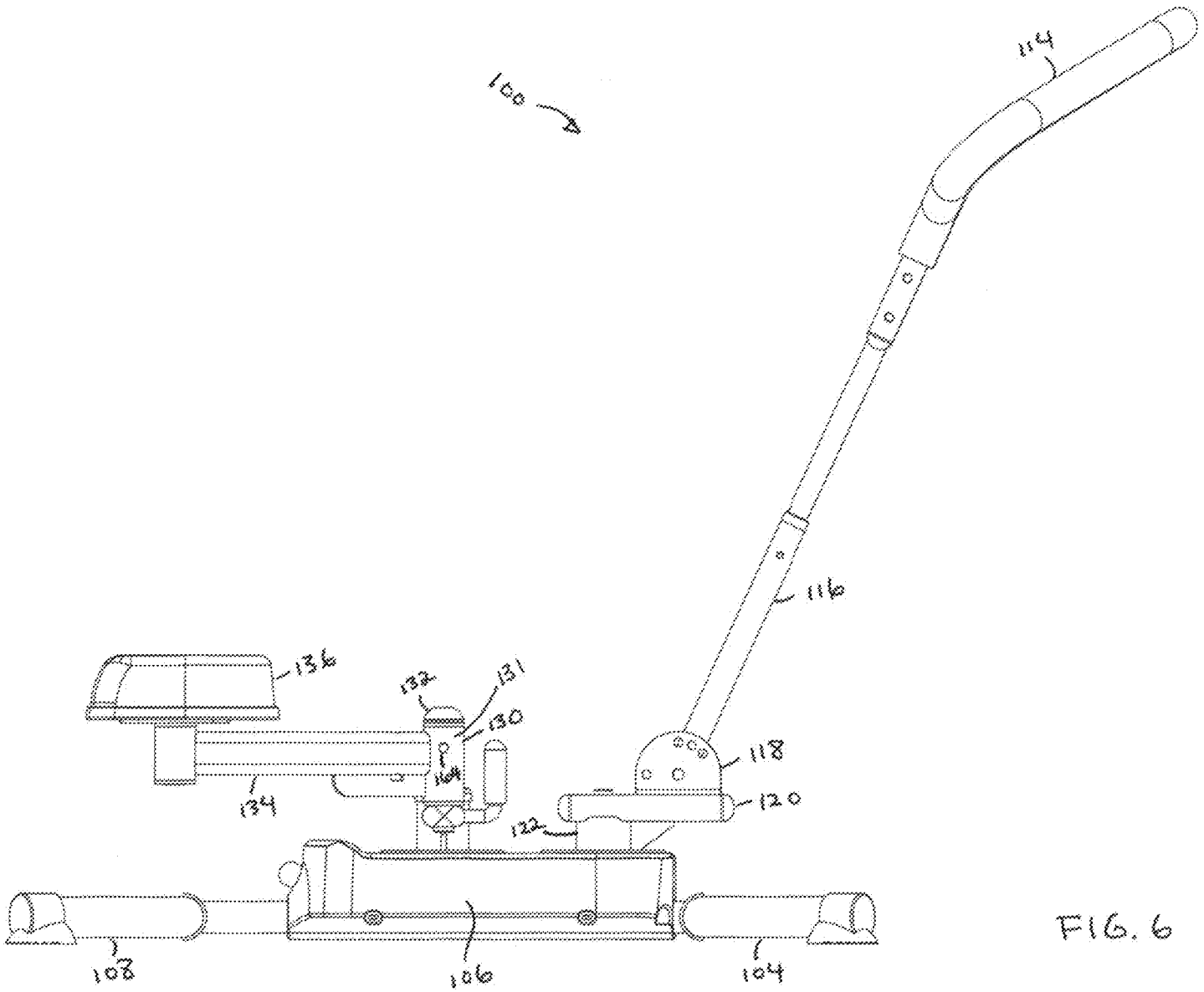
FIG. 6 is a side view of an exercise equipment assembly according to one embodiment.

Different views of the exercise equipment assembly 100 of FIG. 1 are shown in FIGS. 2-6. For example, FIG. 2 is a top view of the exercise equipment assembly shown in FIG. 1, FIG. 3 is a bottom view of the exercise equipment assembly shown in FIG. 1, FIG. 4 is a front view of the exercise equipment assembly shown in FIG. 1, FIG. 5 is a back view of the exercise equipment assembly shown in FIG. 1, and FIG. 6 is a side view of the exercise equipment assembly shown in FIG. 1 in which like reference numerals identify the same parts.

In operation of the exercise equipment assembly 100, with reference to FIGS. 1 and 2, a user positions their knees on the first 136 and second 148 knee supports and grabs the handle bar 114 with their hands and begins the exercise routine by moving the elongated handle 116 in a clockwise direction (see FIG. 2) as denoted by arrow 152 and generally at the same time, moving both of the knee supports 136, 148 in unison in a counter-clockwise direction (see FIG. 2) as denoted by arrows 156 and 160. Then, the user moves the elongated handle 116 in a counter-clockwise direction (see FIG. 2) as denoted by arrow 154 and generally at the same time, moving both of the knee supports 136, 148 in unison in a clockwise direction (see FIG. 2) as denoted by arrows 158 and 162. The above described motions in the clockwise and counter-clockwise directions are repeated as needed for the duration of the exercise routine which effectively exercises the stomach or abdomen as well as other parts of the user's body. In the above described mode of operation, the removable pins are inserted in the through-holes 164 and 166.

Figure 7:
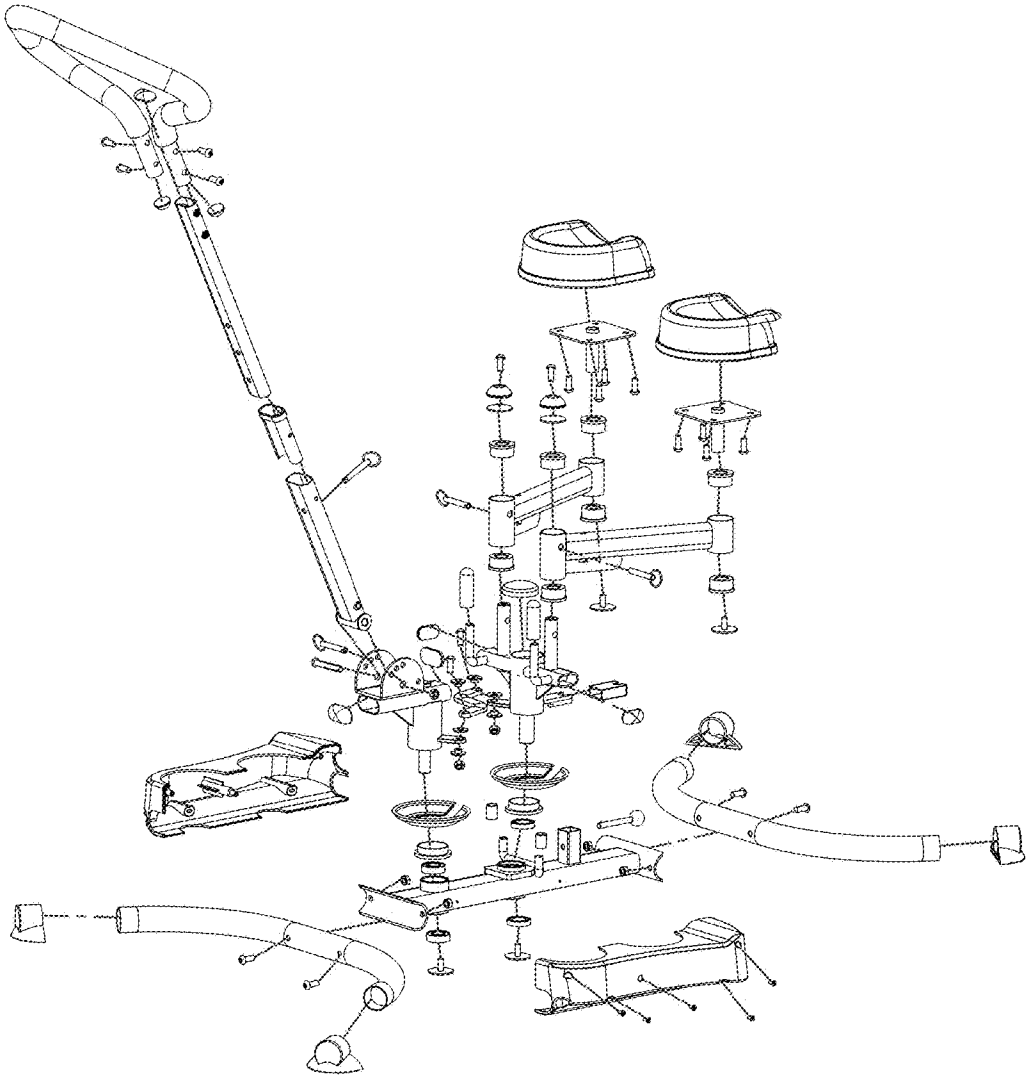
FIG. 7 is an exploded view of an exercise equipment assembly according to one embodiment.

In another mode of operation of the exercise equipment assembly 100, the removable pins as described above may be removed from the through-holes 164, 166 such that the knee supports 136, 148 move away and towards each other while the elongated handle remains stationary. For example, the user moves the first knee support 136 in a counter-clockwise direction (see FIG. 2) as denoted by arrow 156 while generally at the same time, the user moves the second knee support 148 in a clockwise direction (see FIG. 2) as denoted by arrow 162. Then, the user moves the first knee support 136 in a clockwise direction (see FIG. 2) as denoted by arrow 158 while generally at the same time, the user moves the second knee support 148 in a counter-clockwise direction (see FIG. 2) as denoted by arrow 160. The above described motions are repeated as needed for the duration of this second exercise routine which effectively exercises the inner thighs and buttocks of the user as well as other parts of the user's body. FIG. 7 shows an exploded view of the exercise device according to one embodiment.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize. The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such. Furthermore, the terms "first," "second," "third," "fourth," etc. as used herein are meant as labels to distinguish among different elements and may not necessarily have an ordinal meaning according to their numerical designation. It will be appreciated that variants of the above-disclosed and other features and functions, or alternatives thereof, may be combined into may other different systems or applications. Various presently unforeseen or unanticipated alternatives, modifications, variations, or improvements therein may be subsequently made by those skilled in the art which are also intended to be encompassed by the following claims.

What is claimed is:

1. An exercise equipment assembly, comprising:

a stationary base including:

a front elongated support structure;

a back elongated support structure; and a support body coupled between the front and back elongated support structures;

an elongated handle coupled to the support body and extending vertically away from the support body, the elongated handle including a first pivot assembly coupled to the support body, the first pivot assembly to allow the elongated handle to pivot about its vertical axis; and a knee supporting structure coupled to the support body, the knee supporting structure including:

a second pivot assembly coupled to the support body;

a first knee supporting structure coupled to the second pivot assembly, the first knee supporting structure extending horizontally away from the second pivot assembly in a direction opposite from the elongated handle; and a second knee supporting structure coupled to the second pivot assembly, the second knee supporting structure extending horizontally away from the second pivot assembly in a direction opposite from the elongated handle, wherein the second pivot assembly is configured to allow the first and second knee supporting structures to pivot about its vertical axis, wherein each of the first and second knee supporting structures includes a cylindrically-shaped body disposed adjacent to the second pivot assembly, the cylindrically-shaped body including a cavity for receiving a removable pin, and wherein when the removable pins are inserted into the cavities, the entire first and second knee supporting structures pivot in unison and when the removable pins are removed from the cavities, the first and second knee supporting structures pivot towards and away from each other.

2. The exercise equipment assembly of claim 1, wherein the first pivot assembly is disposed at one end of the elongated handle.

3. The exercise equipment assembly of claim 1, wherein the support body includes a cavity and the second pivot assembly is disposed in the cavity of the support body.

4. The exercise equipment assembly of claim 3, wherein the knee supporting structure further includes a first support member and a second support member, each of the first and second support members extending horizontally away from the second pivot assembly and in opposite directions from each other.

5. The exercise equipment assembly of claim 4, wherein the first knee supporting structure includes a first cylindrically-shaped body attached to the first support member, a first elongated member attached to and extending horizontally away from the first cylindrically-shaped body, and a first knee support attached to a distal end of the first elongated member.

6. The exercise equipment assembly of claim 5, wherein the first cylindrically-shaped body includes a horizontally extending through-hole for receiving a removable pin.

7. The exercise equipment assembly of claim 6, wherein when the removable pin is inserted into the through-hole, the first cylindrically-shaped body pivots and when the removable pin is removed from the through-hole, an outer shell portion of the first cylindrically-shaped body pivots while an inner portion of the first cylindrically-shaped body is fixed.

8. The exercise equipment assembly of claim 5, wherein the first knee support includes a cavity for supporting a knee of a user.

9. The exercise equipment assembly of claim 4, wherein the second knee supporting structure includes a second cylindrically-shaped body attached to the second support member, a second elongated member attached to and extending horizontally away from the second cylindrically-shaped body, and a second knee support attached to a distal end of the second elongated member.

10. The exercise equipment assembly of claim 9, wherein the second cylindrically-shaped body includes a horizontally extending through-hole for receiving a removable pin.

11. The exercise equipment assembly of claim 10, wherein when the removable pin is inserted into the through-hole, the second cylindrically-shaped body pivots and when the removable pin is removed from the through-hole, an outer shell portion of the second cylindrically-shaped body pivots while an inner portion of the second cylindrically-shaped body is fixed.

12. The exercise equipment assembly of claim 9, wherein the second knee support includes a cavity for supporting a knee of a user.

13. The exercise equipment assembly of claim 1, wherein each of the front and back elongated support structures is curved in a direction opposite from each other.

14. The exercise equipment assembly of claim 1, wherein the elongated handle includes a triangularly-shaped handle bar disposed at a distal end of the elongated handle.

15. The exercise equipment assembly of claim 14, wherein the first pivot assembly is disposed in a cavity within the support body.

16. The exercise equipment assembly of claim 1, wherein the first pivot assembly is longitudinally spaced apart from the second pivot assembly.

17. The exercise equipment assembly of claim 16, wherein the second pivot assembly is positioned between the first knee supporting structure and the second knee supporting structure.

18. The exercise equipment assembly of claim 16, wherein the knee supporting structure further includes a first L-shaped member and a second L-shaped member, the first L-shaped member to limit the rotation of the first knee supporting member in a counter-clockwise direction and the second L-shaped member to limit the rotation of the second knee supporting structure in a clockwise direction.

* * * * *